United States Patent [19]

Kawai

[11] Patent Number: 5,048,430

[45] Date of Patent: Sep. 17, 1991

[54] METHOD OF STOPPING COMBUSTION IN RESTRAINED COMBUSTION FURNACE IN SAFETY AND COMBUSTION STOP SYSTEM THEREFOR

[75] Inventor: Hiroaki Kawai, Kasugai, Japan

[73] Assignee: NGK Insulators, Ltd., Japan

[21] Appl. No.: 598,192

[22] Filed: Oct. 16, 1990

[30] Foreign Application Priority Data

Oct. 20, 1989 [JP] Japan ..... 1-274536

[51] Int. Cl.[5] ..... F23N 5/24

[52] U.S. Cl. ..... 110/193; 110/210; 110/237; 110/345

[58] Field of Search ..... 110/345, 210, 237, 193

[56] References Cited

U.S. PATENT DOCUMENTS 3,511,194 5/1970 Stookey ..... 110/210

3,922,974 12/1975 Hempelmann ..... 110/237

4,938,156 7/1990 Yahata ..... 110/237

*Primary Examiner*—Carroll B. Dority

*Attorney, Agent, or Firm*—Parkhurst, Wendel & Rossi

[57] ABSTRACT

A method of stopping combustion in a restrained combustion furnace in which wastes to be incinerated are gasified and then burnt with an air amount lower than a theoretical combustion air amount, in case of emergency, the method including steps of shutting off a combustion air supply line connected to the restrained combustion furnace, simultaneously feeding inert gas to lower portions and an outlet side of the furnace, and opening a bypass line connected to an upper portion of the furnace to flow gas in the furnace through a filter to a waste gas stack, thereby safely stopping the combustion in the restrained combustion furnace in case of emergency.

12 Claims, 1 Drawing Sheet

METHOD OF STOPPING COMBUSTION IN RESTRAINED COMBUSTION FURNACE IN SAFETY AND COMBUSTION STOP SYSTEM THEREFOR

Background of the Invention

1. Field of the Invention

The present invention relates to a method of stopping combustion in a restrained combustion furnace which is used for incinerating radioactive wastes, in case of emergency and to a combustion stop system therefor.

2. Related Art Statement

The restrained combustion furnace in which wastes to be incinerated are gasified and burnt with an air ratio lower than a theoretical combustion air amount, has been used as a furnace for incinerating general wastes since the waste gas from the furnace can be easily treated.

Such a restrained combustion furnace is usually not provided with a system for stopping combustion in the furnace in case of emergency such as failure of an electric power source so that the combustion is naturally discontinued when the combustion air supplying blower is stopped.

However, it is recently required to use the restrained combustion furnace for incinerating miscellaneous solid wastes or the like contaminated by radioactivity generated from an atomic power plant. In this case, it is necessary that the combustion in the restrained combustion furnace is safely stopped in an emergency without scattering of combustible gas and ashes contaminated by radioactivity into the air rather than waiting until the combustion in the furnace is naturally discontinued.

SUMMARY OF THE INVENTION

The object of the invention is to provide a method and a system for safely stopping combustion in a restrained combustion furnace in case of emergency such as failure of an electric power source and the like while the combustible gas and ashes contaminated by radioactivity are prevented from scattering out of the furnace.

The above-mentioned object has been achieved by a method of safely stopping combustion in a restrained combustion furnace in case of emergency according to the present invention comprising the steps of shutting off a combustion air supply line connected to the restrained combustion furnace in which wastes to be incinerated are gasified and then burnt with an air amount lower than a theoretical combustion air amount, simultaneously feeding inert gas such as $CO_2$, $N_2$ or the like to a lower portion and outlet side of the furnace to stop combustion in the furnace, and opening a bypass line connected to an upper portion of the furnace to flow gas in the furnace through a filter to a waste gas stack in the emergency.

A system for safely stopping combustion in a restrained combustion furnace in case of emergency, comprises a shut-off valve adapted to be actuated in the emergency and provided in a combustion air supply line which is connected to the restrained combustion furnace in which wastes to be incinerated are gasified and then burnt with an air ratio lower than a theoretical combustion air amount, an inert gas source adapted for feeding inert gas such as $CO_2$, $N_2$ or the like into the furnace in the emergency, and a bypass line connected to an upper portion of the furnace and adapted for flowing gas in the furnace through a filter to a waste gas stack.

With the arrangement according to the invention, the combustion in the restrained combustion furnace in case of emergency can be safely stopped without any leakage of radioactive gas or the like into the air.

BRIEF DESCRIPTION OF THE DRAWING

The accompanying drawing is a block diagram of an embodiment of a system according to the invention.

DESCRIPTION OF THE PREFERRED EMBODIMENT

Figure 1:
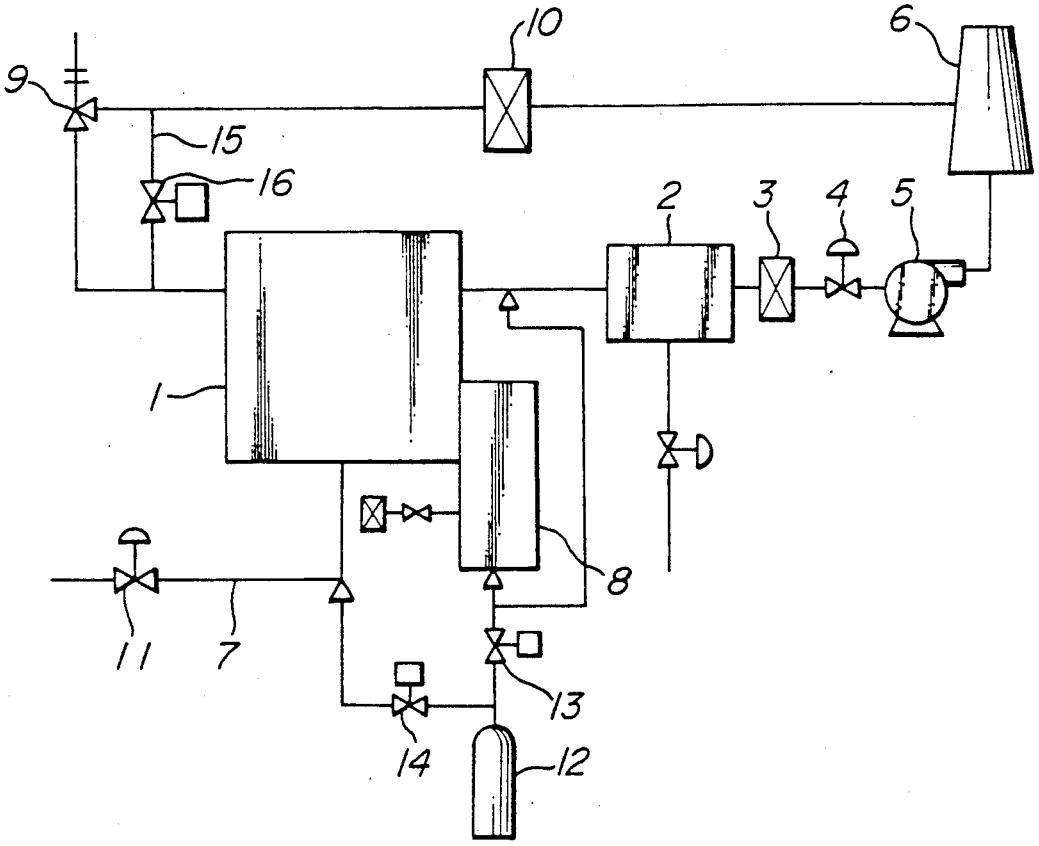

The invention will be described in more detail in the following with reference to the accompanying drawing showing a preferred embodiment of the combustion stopping system according to the invention.

A restrained combustion furnace shown in FIG. 1 comprises a furnace body 1 to which is connected a secondary combustion furnace 2 for combusting waste gas from the furnace body 1. The secondary combustion furnace 2 is communicated through a waste gas refining filter 3, a pressure control valve 4 and a waste gas blower 5 with a waste gas stack 6 by a waste gas conduit.

In a normal running of the restrained combustion furnace, combustion air is supplied to the furnace body 1 by a combustion air supply line 7 in an amount less than a theoretical combustion air amount to gasify and then restrainedly burn wastes to be incinerated in the furnace body 1. Thus generated waste gas is discharged from the furnace body 1 through the stack 6 into the air. Meanwhile, incinerated ashes are deposited in an ashes removing box 8 to remove the ashes for a further treatment. To the upper portion of the furnace body 1 is connected a relief duct provided with a safety valve 9 which relieves a gas from the furnace body to the stack 6 through a filter 10 by the relief duct when a pressure of gas in the furnace body is increased above a predetermined level.

A combustion stop system according to the present invention is arranged in the aforementioned restrained combustion furnace.

Firstly, the combustion stop system includes a valve 11 provided at the combustion air supply conduit 7 for shutting off the combustion air supply conduit in case of emergency.

Secondary, an inert gas source 12 is connected to the lower portion and the waste gas outlet of the furnace body 1 via valves 13 and 14, respectively, for supplying inert gas such as $CO_2$, $N_2$ and the like to the furnace body in case of emergency. In a preferred embodiment, a $CO_2$ gas bomb may be used as the inert gas source.

Thus, in case of emergency, the valves 13 and 14 are simultaneously opened to feed the inert gas from the gas bomb to the lower portion of the furnace body such as the combustion air supply conduit 7 and the ashes removing box 8 and the other and the waste gas outlet connected to the secondary combustion furnace 2.

Furthermore, a bypass line 15 is provided for bypassing the safety valve 9 at the upper portion of the furnace. The bypass line 15 is provided with a valve 16 which is opened in case of emergency to flow the gas from the furnace body through the filter 10 to the waste gas stack 6.

The combustion stop system of the restrained combustion furnace according to the present invention arranged as mentioned above permits a restrained combustion by supplying air in an amount less than the theoretical combustion air amount from the combustion air supply line 7 during the normal running of the furnace, and to supply the waste gas from the furnace body 1 to the secondary combustion furnace 2 in which the waste gas is completely burnt. The burnt waste gas is sucked out the secondary combustion furnace 2 by the gas blower 5 and discharged through the waste gas stack 6 into the air.

However, in case of emergency such as a failure of electric power source, the waste gas blower 5 is also stopped and therefore the waste gas is not smoothly treated at the downstream side of the secondary combustion furnace 2. According to the present invention, in case of emergency, the valve 11 is simultaneously closed to shut off supply of air from the combustion air supply line 7 to the furnace body 1. At the same time, the valves 13 and 14 are opened to supply inert gas from an inert gas source 12 to the lower portion and outlet side of the furnace body 1. As the result, a combustion source which has not been burnt in the furnace body disappears and the combustion in the furnace body therefore is quickly discontinued, while a curtain of the inert gas is formed at the outlet side of the furnace body to prevent the gas from flowing out of the furnace body. In this embodiment, the inert gas is also simultaneously fed to the combustion air supply line 7. Furthermore, according to the invention, in case of emergency, the valve 16 is simultaneously opened to communicate the upper portion of the furnace body through the bypass line 15 with the waste gas stack 6 to discharge gas generated in the furnace body through a filter 10 to the waste gas stack 6 until the combustion in the furnace body is stopped.

Thus, according to the present invention, the combustion in the furnace body in case of emergency is quickly stopped and the gas in the furnace is prevented from leaking to secondary combustion furnace 2 and the downstream side thereof and permitted to pass through the filter 10 in the relief duct to the waste gas stack, thereby safely stopping the restrained combustion furnace.

What is claimed is:

1. A method of safely stopping combustion in a restrained combustion furnace in which wastes to be incinerated are gasified and then burnt with an air amount lower than a theoretical combustion air amount, in case of emergency, the method comprising the steps of shutting off a combustion air supply line connected to the furnace, simultaneously feeding inert gas to a lower portion of the furnace and an outlet conduit of waste gas leaving the furnace and stop combustion in the furnace, opening a bypass line connected to an upper portion of the furnace, and flowing gas in the furnace through a filter to a waste gas stack through said bypass line.

2. The method claimed in claim 1, wherein the inert gas consists of $CO_2$ or $N_2$.

3. The method claimed in claim 1, wherein the furnace includes a furnace body and an incinerated ashes removing box connected to the furnace body, the inert gas being fed to lower portions of the furnace body and the ashes removing box in case of emergency.

4. The method claimed in claim 1, wherein the inert gas is fed to the furnace through a combustion air supply line in case of emergency.

5. The method claimed in claim 1, wherein the bypass line is connected to a conduit including a relief duct.

6. A system for safely stopping combustion in a restrained combustion furnace in case of emergency, comprising a shut-off valve adapted to be actuated in the emergency and provided in a combustion air supply line which is connected to the furnace in which wastes to be incinerated are gasified and then burnt with an air amount lower than a theoretical combustion air amount, an inert gas source operatively connected for feeding inert gas into the furnace and through a waste gas conduit connected between the furnace and a waste gas stack in an emergency, and a bypass line having a valve and a filter and being connected to an upper portion of the furnace and said waste gas stack.

7. The system claimed in claim 6, wherein the inert gas source is a gas bomb consisting of $CO_2$ or $N_2$.

8. The system claimed in claim 6, wherein the restrained combustion furnace includes a furnace body and an incinerated ashes removing box.

9. The system claimed in claim 8, wherein the furnace body has an outlet connected to the waste gas conduit which includes a secondary combustion furnace, waste gas refining filter, a pressure control valve and a waste gas blower.

10. The system claimed in claim 8, wherein the combustion air supply line is connected to a lower portion of the furnace body.

11. The system claimed in claim 8, wherein the inert gas source is connected to the combustion air supply line and a lower portion of the incinerated ashes removing box through respective valves which are opened in case of emergency.

12. The system claimed in claim 8, wherein the furnace body is connected to the waste gas stack through a relief duct in parallel with said bypass line and including a safety relief valve.

* * * * *